US008240889B2

(12) United States Patent
Gong et al.

(10) Patent No.: US 8,240,889 B2
(45) Date of Patent: Aug. 14, 2012

(54) LED LAMP CASING

(75) Inventors: Fu-Bo Gong, Shenzhen (CN); Wen-Hsiang Lu, Tu-Cheng (TW); Huai-Shan Gu, Shenzhen (CN); Ting Dong, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/039,344

(22) Filed: Mar. 3, 2011

(65) Prior Publication Data

US 2012/0098408 A1 Apr. 26, 2012

(30) Foreign Application Priority Data

Oct. 25, 2010 (CN) ..... 2010 1 0517911

(51) Int. Cl.
*F21V 17/00* (2006.01)

(52) U.S. Cl. ..... 362/375; 313/498; 362/374; 362/368; 362/438

(58) Field of Classification Search ..... 257/40, 257/72, 98–100, 642–643, 759; 313/498–512; 315/169.1, 169.3; 427/58, 64, 66, 532–535, 427/539; 428/690–691, 917; 438/26–29, 438/34, 82, 455; 445/24–25; 362/543–545, 362/555, 800, 546–549, 249.01–249.03, 362/362, 374, 375, 225, 217.05, 217.1, 217.14, 362/227, 296.01, 310, 311.02; 220/2.1 R, 220/2.2

See application file for complete search history.

*Primary Examiner* — Mariceli Santiago
*Assistant Examiner* — Donald Raleigh
(74) *Attorney, Agent, or Firm* — Altis Law Group, Inc.

(57) ABSTRACT

A casing includes a main body, a ring defining a number of notches, a number of clasping members, and a number of first and second latching members. The main body defining a number of first through openings. The number of clasping members includes a first elastic arm defining a second through opening and comprising a first hook. The first latching member includes a second elastic arm and a second hook. The second latching member includes a third elastic arm and a third hook. The first hook clasps the bottom of the ring. The second hook clasps an edge of the corresponding second through opening. The third hook clasps an edge of the corresponding first through opening.

8 Claims, 9 Drawing Sheets

LED LAMP CASING

BACKGROUND

1. Technical Field

The present disclosure relates to an light emitting diode (LED) lamp casing.

2. Description of Related Art

Clasping mechanisms including hooks are commonly used for connecting casings. Usually, a clasping mechanism is made up of an elastic material, the clasping mechanism deforms for assembling and disassembling of the casings. However, the restoring forces of the clasping mechanism become weak or non-existence after repeated use. If this happens, the casing may unexpectedly disassemble when an external force is applied thereto. Thus, the reliability of the casing decreases with use.

Therefore, what is needed is an LED lamp casing alleviating the limitations described above.

BRIEF DESCRIPTION OF THE DRAWINGS

The components in the drawings are not necessarily drawn to scale, the emphasis instead being placed upon clearly illustrating the principles of an LED lamp casing. Moreover, in the drawings, like reference numerals designate corresponding parts throughout the several views.

DETAILED DESCRIPTION

Figure 1:
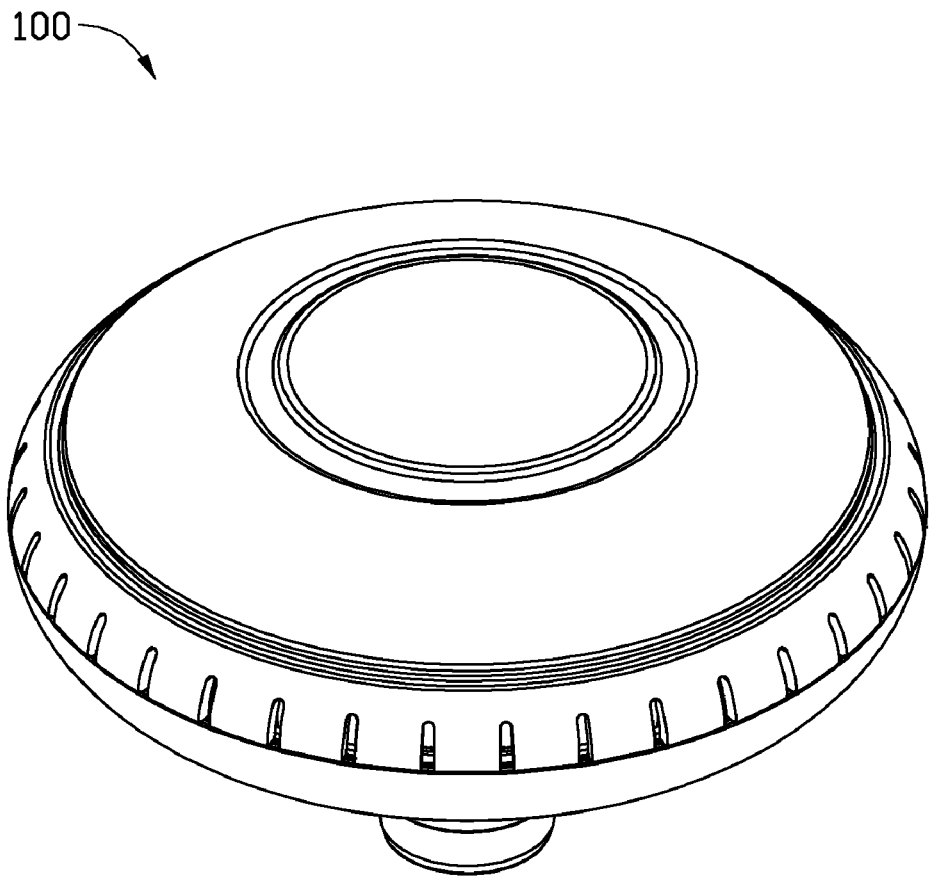
FIG. 1 is an isometric view of an exemplary embodiment of an LED lamp casing.
Figure 2:
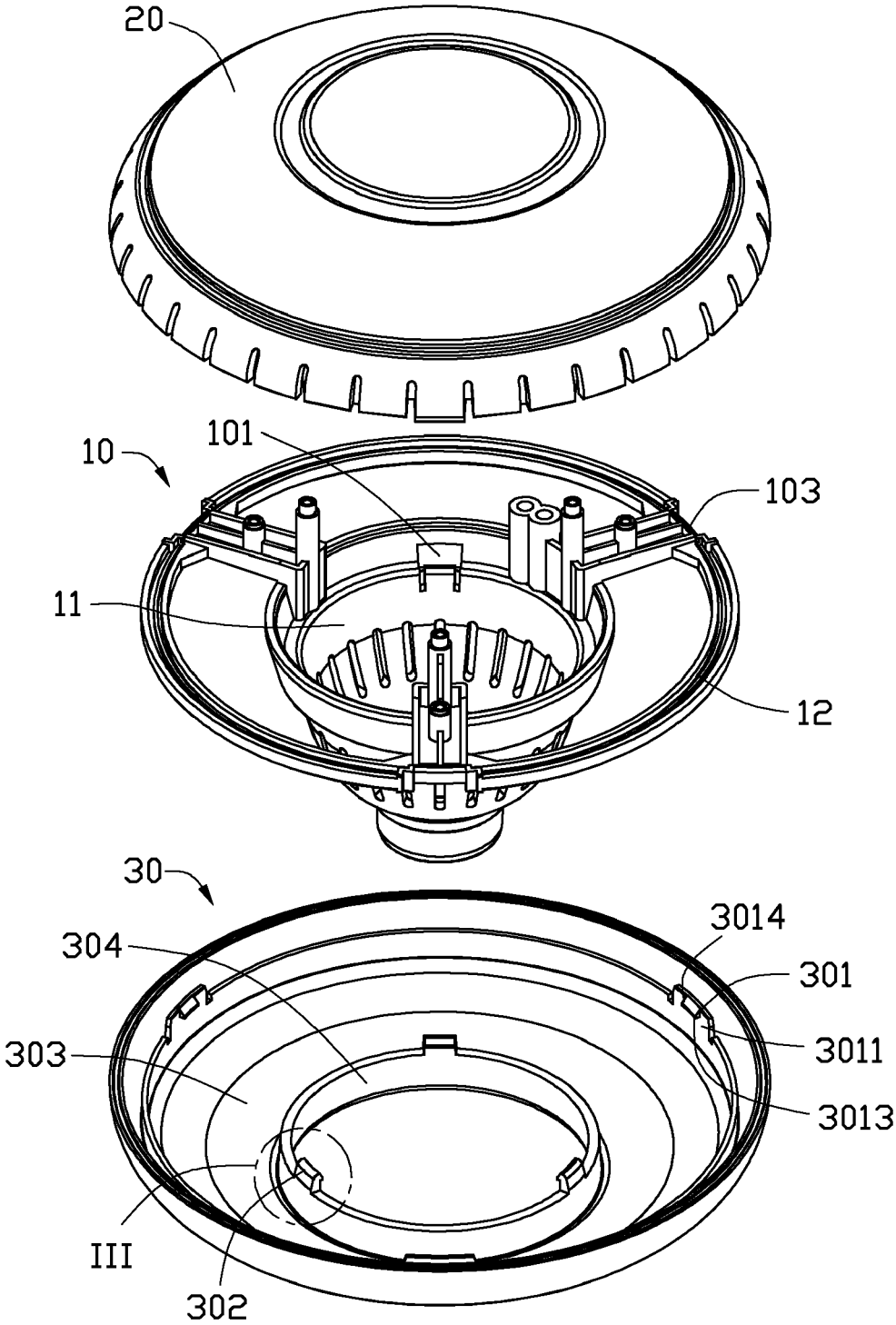
FIG. 2 is an exploded view of the LED lamp casing of FIG. 1.

Referring to FIGS. 1 and 2, an exemplary embodiment of an LED lamp casing 100 is disclosed. The LED lamp casing 100 includes an upper casing 20 and a lower casing 30 that are connected together by a connecting member 10.

The connecting member 10 is hollow and includes a main body 11 and a ring 12 connected to the main body 11 by a number of bars extending radially outward from the main body 11. The main body 11 defines a number of first through openings 101 in its lateral wall. The ring 12 defines a number of notches 103 in its lateral wall.

Figure 4:
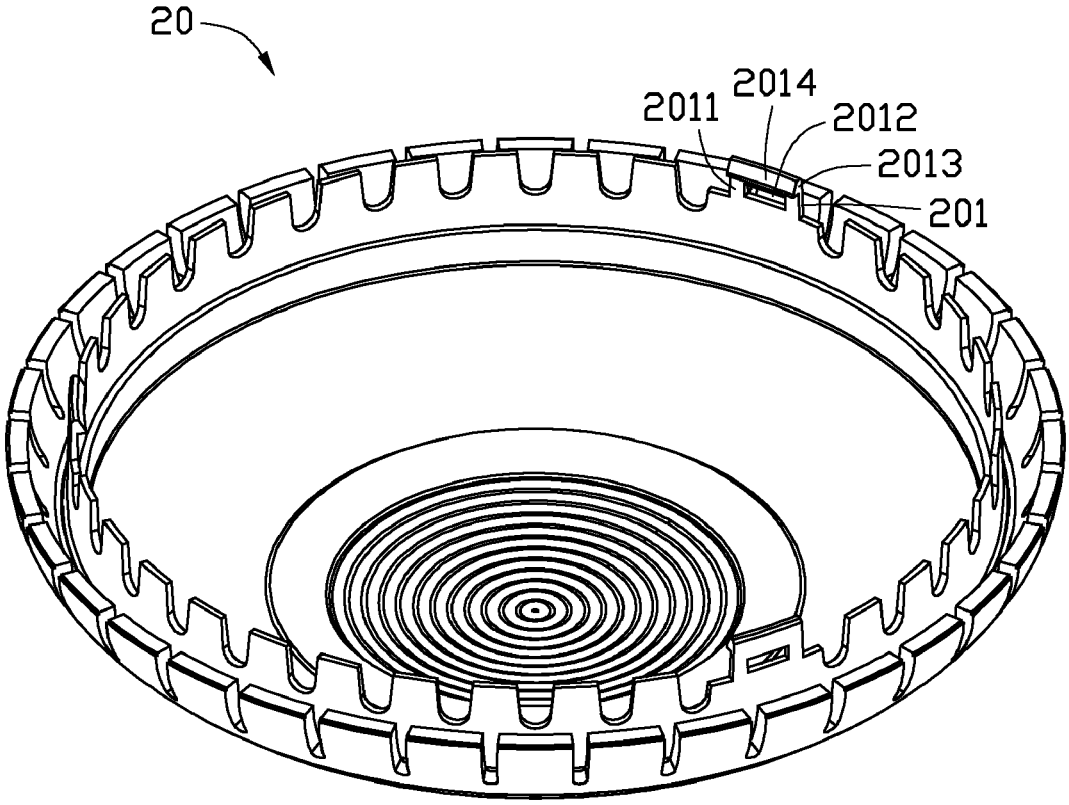
FIG. 4 is an isometric view of an upper casing of the LED lamp casing of FIG. 1.
Figure 5:
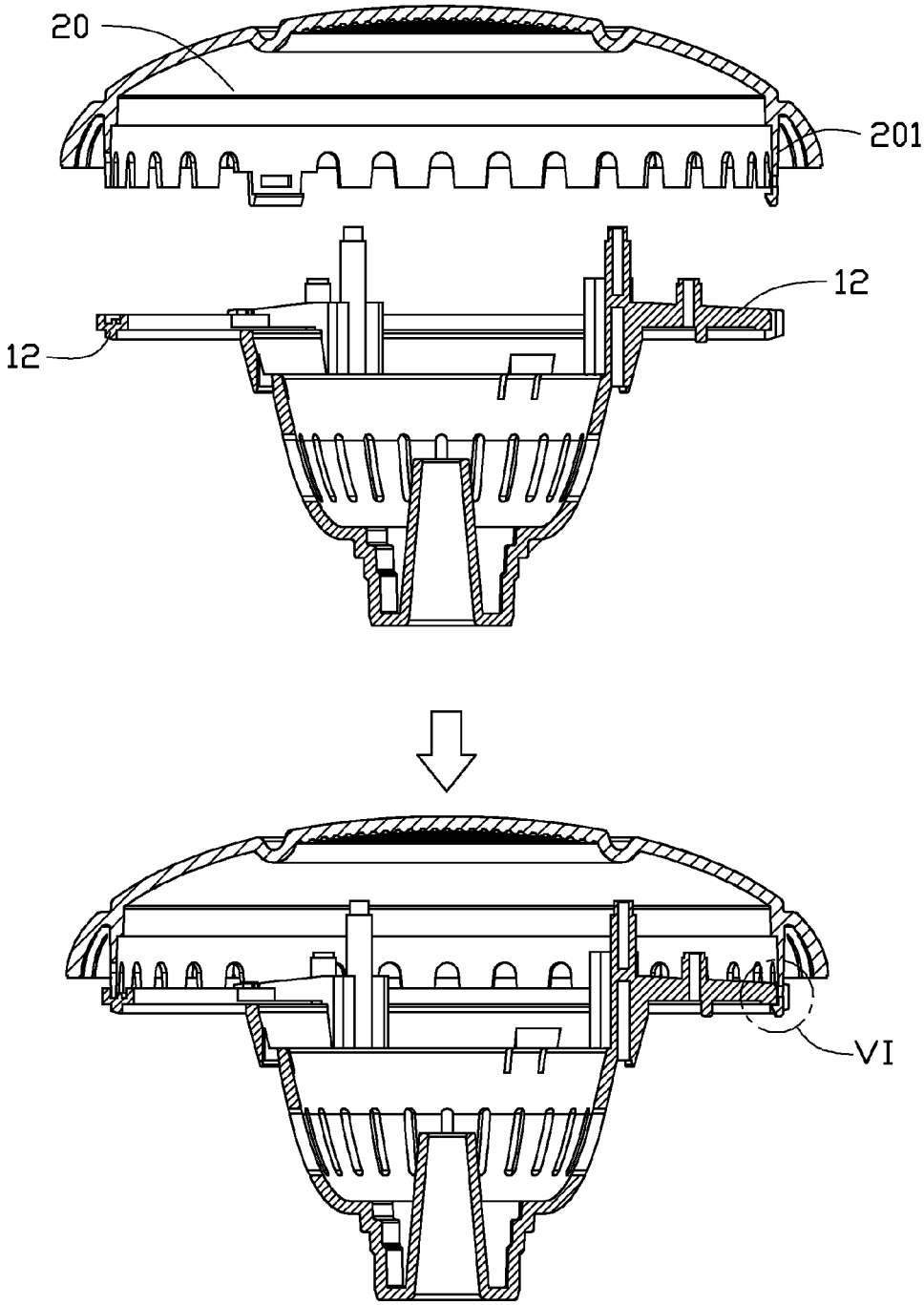
FIG. 5 is a cross-sectional view of the LED lamp casing of FIG. 1.
Figure 6:
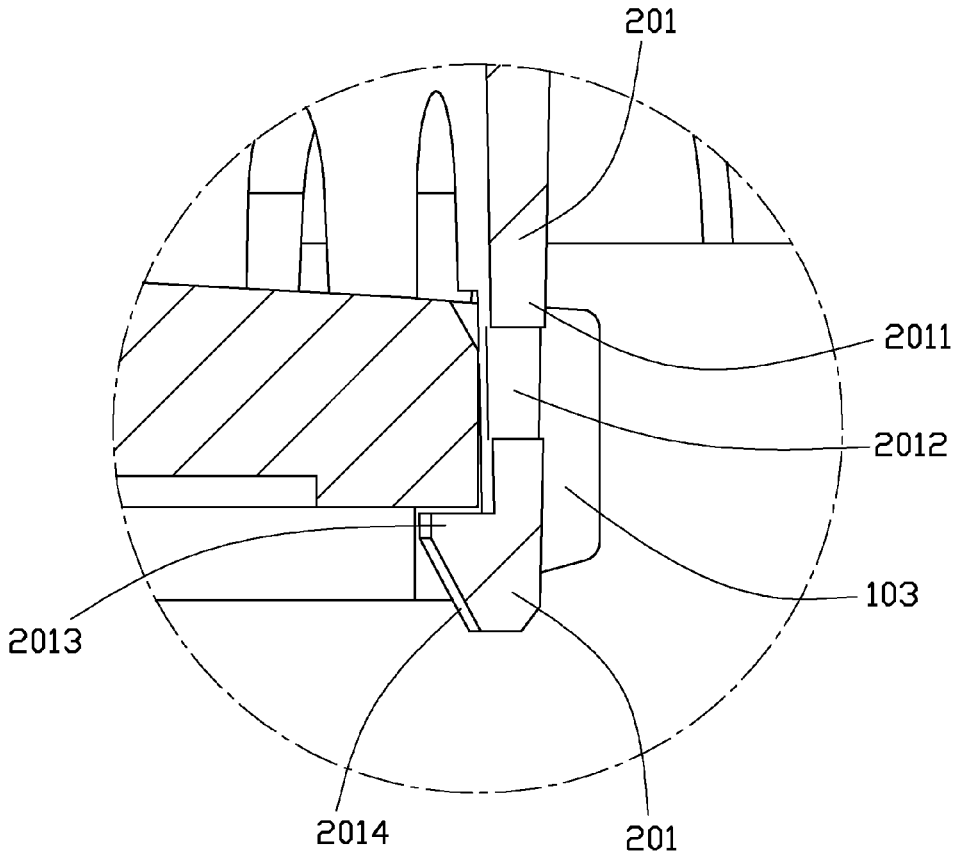
FIG. 6 is a partial, enlarged view of a portion VI of the LED lamp casing of FIG. 5.
Figure 7:
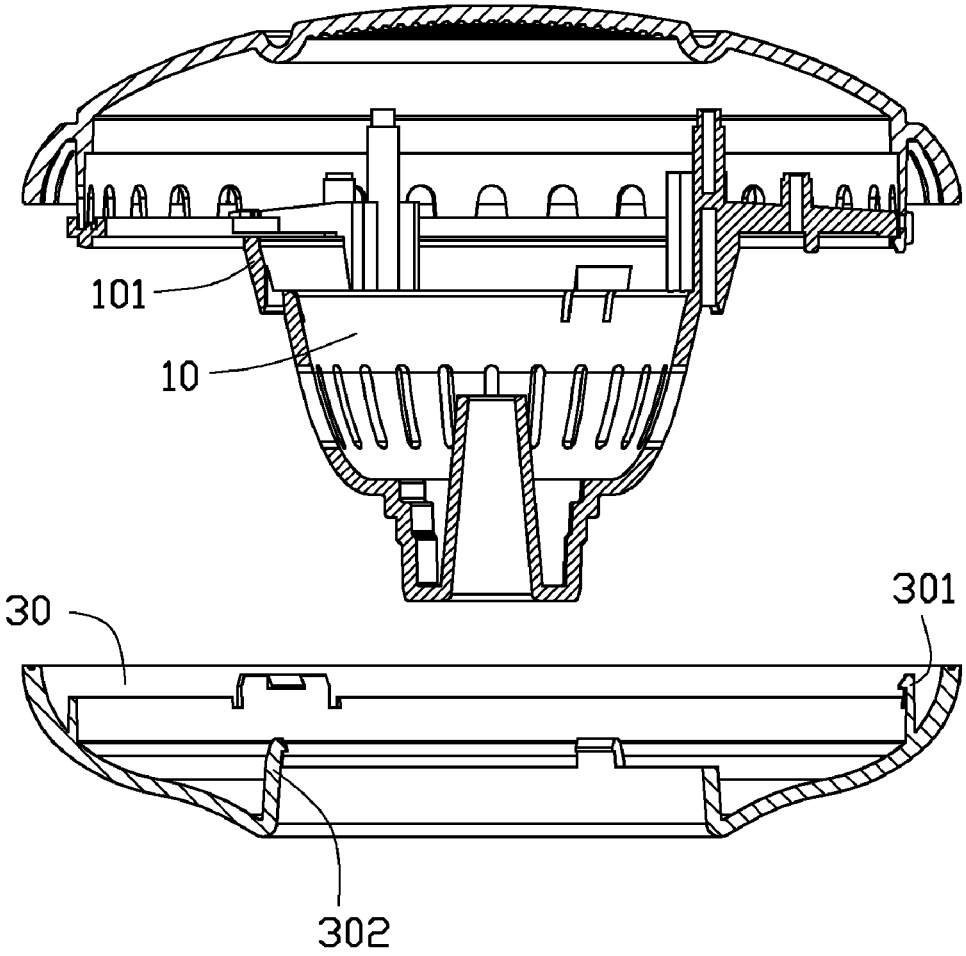
FIG. 7 is a cross-sectional view showing the assembly of the LED lamp casing of FIG. 1.
Figure 8:
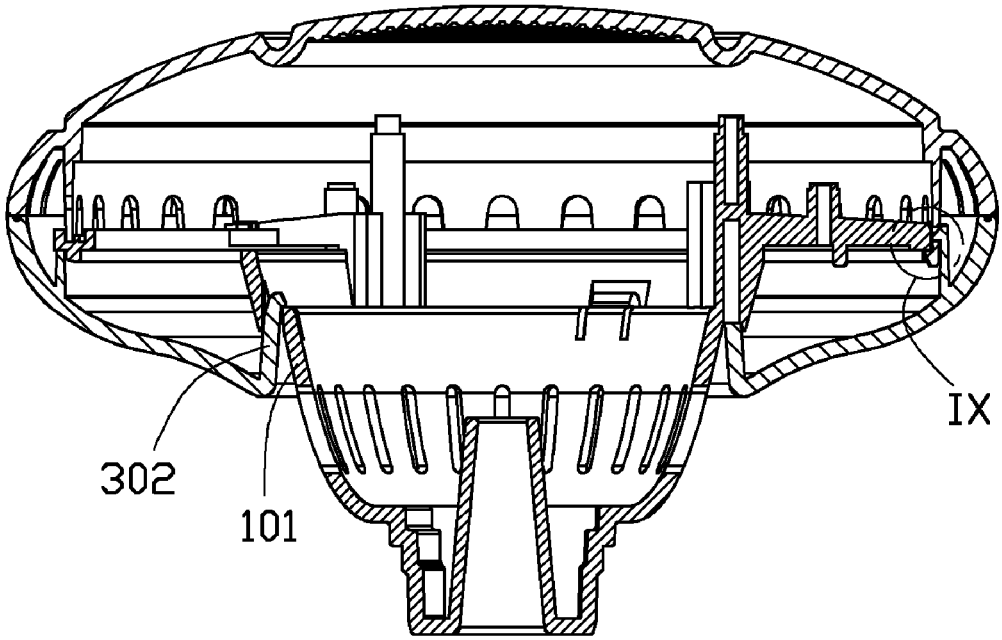
FIG. 8 is a cross-sectional view of the LED lamp casing of FIG. 1.
Figure 9:
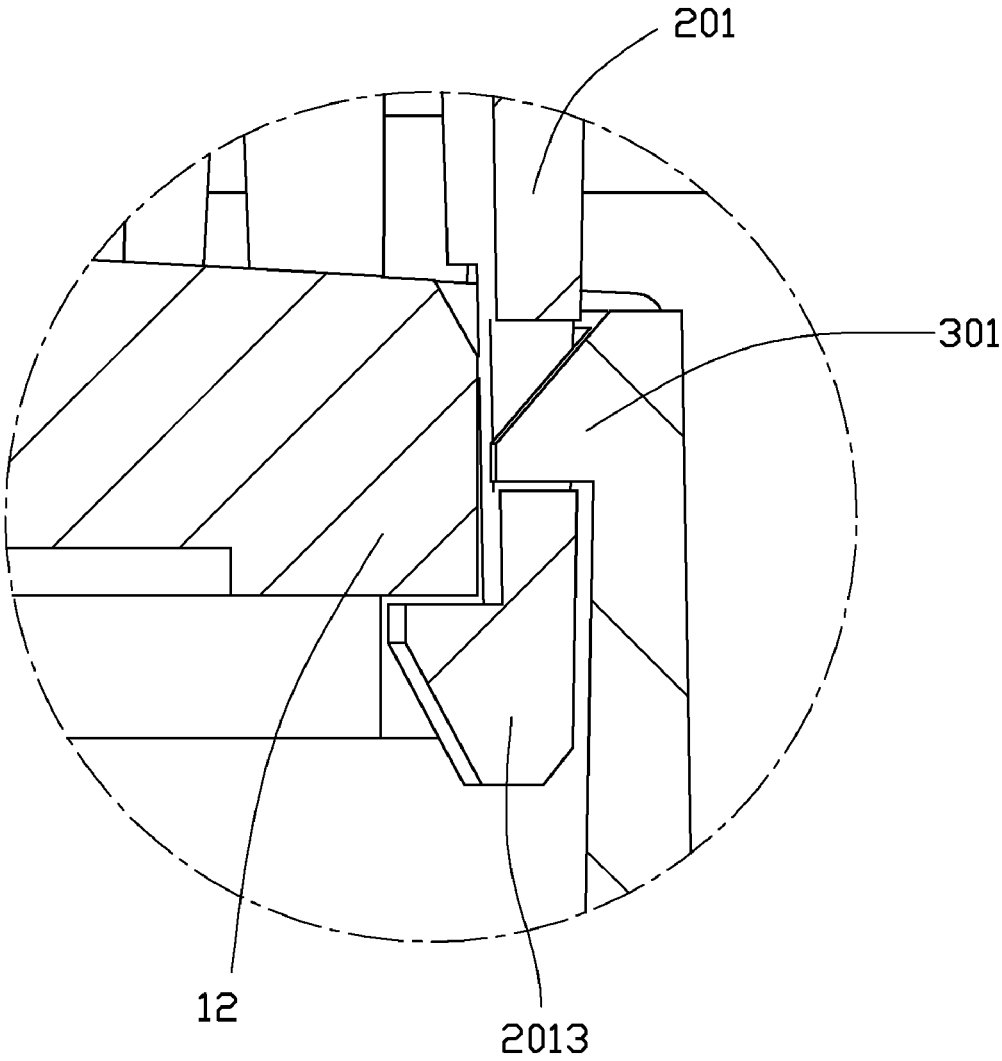
FIG. 9 is a partial, enlarged view of a portion IX of the LED lamp casing of FIG. 8.

Referring also to FIG. 4, a number of clasping members 201 are formed on the upper casing 20. Each of the clasping members 201 includes a first elastic arm 2011. The first elastic arm 2011 defines a second through opening 2012 and includes a first hook 2013 extending from its distal end. The first hook 2013 includes a first sloping surface 2014 and can be received in the notch 103.

The lower casing 30 can be a hollow semicircle. The lower casing 30 includes a first open end 303 having a first diameter, and a second open end 304 having a second diameter. A number of first latching members 301 protrude from the inner wall of the lower casing 30 toward the first open end 303. The first latching member 301 includes a second elastic arm 3011 and a second hook 3013 extending from its distal end. The second hook 3013 includes a second sloping surface 3014 and can be received in the second through opening 2012.

Figure 3:
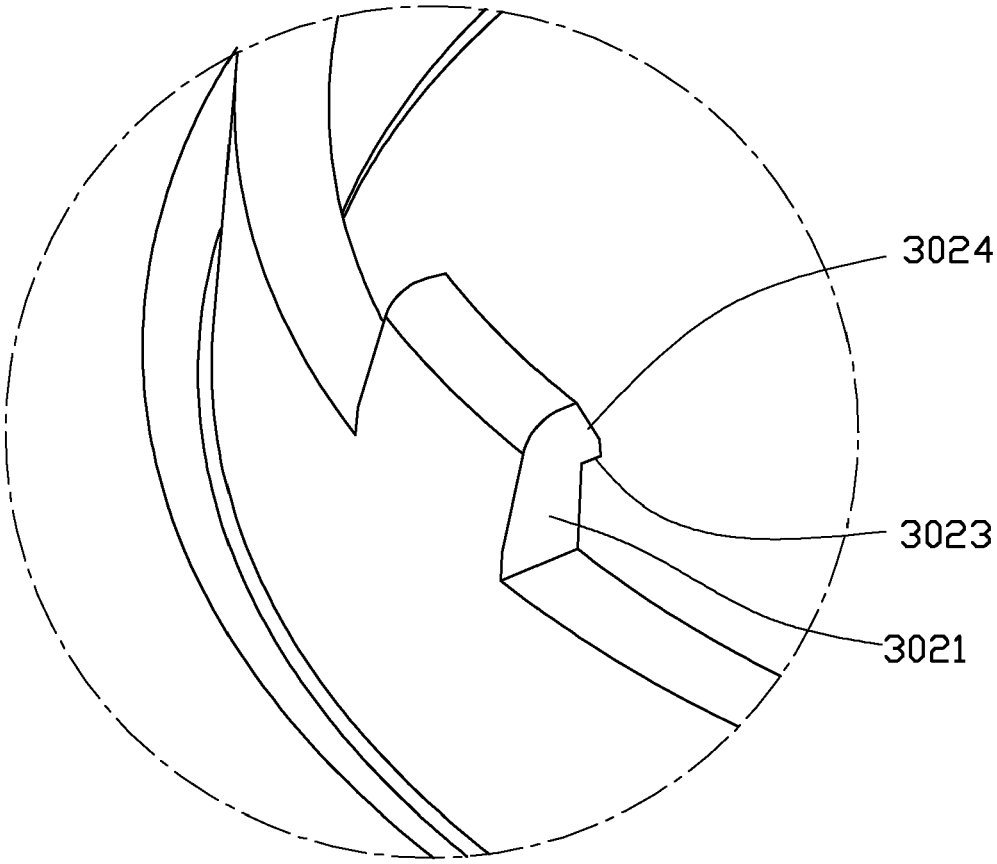
FIG. 3 is a partial, enlarged view of a portion III of a lower casing of the LED lamp casing of FIG. 2.

Referring to FIGS. 2 and 3, a number of second latching members 302 protrude from the edge of the second open end 304 toward the first open end 303. The second latching member 302 includes a third elastic arm 3021 and a third hook 3023 extending from its distal end. The third hook 3023 includes a third sloping surface 3024 and can be received in the first through opening 101.

Referring to FIGS. 2-6, the process of connecting the upper casing 20 with the connecting member 10 is as follows: aligning the clasping members 201 of the upper casing 20 with the notches 103 of the connecting member 10. Rotating the upper casing 20 or the connecting member 10 to cause the clasping members 201 to be inserted into the corresponding notches 103. In this embodiment, the first sloping surface 2014 on the first hook 2013 of the clasping members 201 contacts the notch 103, and a chamfer may be allocated on the edge of the notch 103 for guiding the clasping members 201 to be inserted into the corresponding notches 103. During the process, the distal end of the first hook 2013 slides along the inner wall of the notch 103, and the first elastic arm 2011 of the clasping member 201 deforms and inclines outward slightly. When the first elastic arm 2011 recovers to its normal state, the first hook 2013 clasps the bottom surface of the ring 12, thus connecting the upper casing 20 with the connecting member 10.

Referring to FIGS. 2 and 7-9, the process of connecting the lower casing 30 with the connecting member 10 is as follows: aligning the first latching members 301 of the lower casing 30 with the notches 103 of the connecting member 10. Aligning the second latching members 302 of the lower casing 30 with the first through openings 101 of the connecting member 10, and rotating the lower casing 20 or the connecting member 10 to cause the first and second latching members 301, 302 to be respectively inserted into the notches 103 and the first through openings 101. Similar to guiding the clasping members 201 to insert into the corresponding notches 103, the first latching member 301 deforms when being inserted into the notch 103, until the second elastic arm 3011 of the second hook 3013 clasps the edge of the second through opening 2012 of the first elastic arm 2011 of the clasping members 201. At the same time, the second latching member 302 deforms when being inserted into the first through opening 101, until the third hook 3023 of the second latching member 302 clasps the edge of the first through opening 101.

In use, the upper casing 20 shifts when an external force is applied thereto, and the clasping members 201 shifts accordingly. However, the clasping members 201 stops shifting because of resisting force of the latching members 301, thus the clasping members 201 will not disengage from the connecting member 10 even when the external force is applied on the upper casing 20. On the other side, the lower casing 30 shifts when an external force is applied thereto, and the latching members 301 shifts accordingly. However, due to the reverse orientations, the hooks 3013, 3023 will not simultaneously disengage from the upper casing 20. Thus, the reliability of the clasping mechanism increases.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A light emitting diode (LED) lamp casing comprising:

a connecting member comprising:

a main body comprising a lateral wall defining a plurality of first through openings; and a ring connected to the main body and defining a plurality of notches in a lateral wall thereof;

an upper casing comprising a plurality of clasping members, each of the plurality of clasping members comprising a first elastic arm defining a second through opening and comprising a first hook; and a lower casing comprising:

a plurality of first latching members, each of the plurality of first latching members comprising a second elastic arm and a second hook extending from a distal end of the second elastic arm; and a plurality of second latching members, each of the second latching members comprising a third elastic arm and a third hook formed on the third elastic arm;

wherein the first elastic arm is inserted in the corresponding notch, the first hook clasps the bottom of the ring, the second elastic arm is inserted in the corresponding second through opening, the second hook clasps an edge of the corresponding second through opening, the third elastic arm is inserted in the corresponding first through opening, and the third hook clasps an edge of the corresponding first through opening.

2. The LED lamp casing as described in claim 1, wherein the first hook comprises a first sloping surface received in the corresponding notch, the second hook comprises a second sloping surface received in the corresponding second through opening, and the third hook comprises a third sloping surface received in the corresponding first through opening.

3. The LED lamp casing as described in claim 1, wherein the connecting member is hollow.

4. The LED lamp casing as described in claim 1, wherein the lower casing is a hollow semicircle.

5. The LED lamp casing as described in claim 4, wherein the lower casing comprises a first open end and a second open end, the plurality of first latching members protrude from an inner wall of the lower casing toward the first open end, and the number of second latching members protrude from an edge of the second open end toward the first open end.

6. A casing comprising:

a main body comprising a lateral wall defining a plurality of first through openings;

a ring connected to the main body and defining a plurality of notches in a lateral wall thereof;

a plurality of clasping members, each of the plurality of clasping members comprising a first elastic arm defining a second through opening and comprising a first hook;

a plurality of first latching members, each of the plurality of first latching members comprising a second elastic arm and a second hook extending from a distal end of the second elastic arm; and a plurality of second latching members, each of the second latching members comprising a third elastic arm and a third hook formed on the third elastic arm;

wherein the first elastic arm is inserted in the corresponding notch, the first hook clasps the bottom of the ring, the second elastic arm is inserted in the corresponding second through opening, the second hook clasps an edge of the second through opening, the third elastic arm is inserted in the corresponding first through opening, and the third hook clasps an edge of the corresponding first through opening.

7. The casing as described in claim 6, wherein the first hook comprises a first sloping surface received in the corresponding notch, the second hook comprises a second sloping surface received in the corresponding second through opening, and the third hook comprises a third sloping surface received in the corresponding first through opening.

8. The casing as described in claim 6, wherein the casing further comprises a first open end and a second open end, the plurality of first latching members protrude from an inner wall of the casing toward the first open end, and the number of second latching members protrude from an edge of the second open end toward the first open end.

* * * * *